US007817926B2

(12) United States Patent
Yano

(10) Patent No.: US 7,817,926 B2
(45) Date of Patent: Oct. 19, 2010

(54) IMAGE FORMING APPARATUS AND OPTIONAL SHEET FEEDING DEVICE

(75) Inventor: Hidetoshi Yano, Tokai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 360 days.

(21) Appl. No.: 11/228,295

(22) Filed: Sep. 19, 2005

(65) Prior Publication Data

US 2006/0067716 A1 Mar. 30, 2006

(30) Foreign Application Priority Data

Sep. 28, 2004 (JP) ..... 2004-281929

(51) Int. Cl.
*G03G 15/00* (2006.01)

(52) U.S. Cl. ..... 399/13

(58) Field of Classification Search ..... 399/391, 399/393, 13, 11, 16, 12, 23
See application file for complete search history.

(56) References Cited

U.S. PATENT DOCUMENTS

| | | | | | |
|---|---|---|---|---|---|
| 4,307,957 | A | * | 12/1981 | Kitagawa et al. | 399/21 |
| 4,699,501 | A | * | 10/1987 | Watanabe et al. | 399/11 |
| 4,966,356 | A | | 10/1990 | Ohyabu et al. | |
| 5,184,184 | A | * | 2/1993 | Hayashi et al. | 399/35 |
| 5,191,382 | A | | 3/1993 | Okamura et al. | |
| 5,485,990 | A | * | 1/1996 | Kato | 271/9.08 |
| 5,612,776 | A | * | 3/1997 | Machino et al. | 399/43 |
| 5,758,249 | A | | 5/1998 | Dutton et al. | |
| 5,819,153 | A | | 10/1998 | Lim | |
| 5,841,362 | A | * | 11/1998 | Nakamura et al. | 382/100 |
| 6,049,346 | A | | 4/2000 | Cho | |
| 6,370,354 | B1 | * | 4/2002 | Chapman et al. | 399/394 |
| 6,643,480 | B2 | * | 11/2003 | Kuwata et al. | 399/107 |
| 2004/0190934 | A1 | * | 9/2004 | Okabe | 399/111 |
| 2005/0019044 | A1 | * | 1/2005 | Uchida | 399/12 |

FOREIGN PATENT DOCUMENTS

JP 60006538 A 1/1985

(Continued)

OTHER PUBLICATIONS

Computer translation JP11-310328a.*

(Continued)

*Primary Examiner*—Quana M Grainger
(74) *Attorney, Agent, or Firm*—Banner & Witcoff, Ltd

(57) ABSTRACT

An image forming apparatus includes: an image forming apparatus main body including an image forming unit that forms an image on a sheet, a detachable main body sheet feeding tray that holds the sheet and a sheet feeding unit that feeds the sheet from the main body sheet feeding tray toward the image forming unit; an optional sheet feeding device that is capable of being added on a lower side of the main body sheet feeding tray and feeds the sheet toward the image forming unit, the optional sheet feeding device having a first detector that detects whether or not the main body sheet feeding tray is attached to a proper position; and a controller that controls operations of the image forming apparatus main body and the optional sheet feeding device based on a detection result of the first detector.

8 Claims, 6 Drawing Sheets

FOREIGN PATENT DOCUMENTS

| | | | | |
|---|---|---|---|---|
| JP | 60230164 | A | | 11/1985 |
| JP | 03115026 | A | | 5/1991 |
| JP | 11199092 | | | 7/1999 |
| JP | 11310328 | | | 9/1999 |
| JP | 2003306251 | A | * | 10/2003 |
| JP | 2004009401 | A | * | 1/2004 |

OTHER PUBLICATIONS

Japanese Office Action in Application No. 2004-281929 with Dispatch Date of Nov. 6, 2007 and English translation thereof.

* cited by examiner

IMAGE FORMING APPARATUS AND OPTIONAL SHEET FEEDING DEVICE

BACKGROUND OF THE INVENTION

1. Field of the Invention

The present invention relates to an image forming apparatus that forms an image by an image forming unit on a sheet by transporting the sheet held in a main body sheet feeding tray, and particularly to an image forming apparatus capable of expanding an optional sheet feeding device on the lower side of the main body sheet feeding tray, and the optional sheet feeding device.

2. Description of the Related Art

Conventionally, an image forming apparatus including an image forming apparatus main body that has an image forming unit for forming an image on a sheet, a detachable main body sheet feeding tray for holding the sheet and a sheet feeding unit for feeding the sheet from the main body sheet feeding tray toward the image forming unit, and an optional sheet feeding device that can be added on the lower side of the main body sheet feeding tray and feeds the sheet toward the image forming unit has been proposed. A portion of the main body sheet feeding tray constitutes a portion of a transport path of the sheet which extends from the optional sheet feeding device to the image forming unit when the main body sheet feeding tray is attached to a proper position (for example, see JP-A-11-310328).

In this kind of image forming apparatus, when the main body sheet feeding tray is attached to the proper position of the image forming apparatus main body, the sheet held in the main body sheet feeding tray can be transported toward the image forming unit by the sheet feeding unit to form an image by the image forming unit on the sheet. Also, when the main body sheet feeding tray is attached to the proper position and the optional sheet feeding device is added on the lower side of the main body sheet feeding tray, the portion of the main body sheet feeding tray constitutes the portion of a transport path of the sheet which extends from the optional sheet feeding device to the image forming unit. Therefore, the sheet can also be fed from the optional sheet feeding device toward the image forming unit through the portion of the main body sheet feeding tray to form an image on the sheet.

SUMMARY

However, in the case of attempting to feed the sheet from the optional sheet feeding device when the main body sheet feeding tray is not attached to the proper position, the portion of the main body sheet feeding tray does not constitute the portion of the transport path, so that there is a possibility that a jam occurs. Therefore, it is conceived that the image forming apparatus main body is provided with a sensor for detecting whether or not the main body sheet feeding tray is attached to the proper position. In the case of detecting that the main body sheet feeding tray is not attached to the proper position through the sensor, sheet feeding from the optional sheet feeding device is inhibited.

When the image forming apparatus main body is provided with such a sensor, however, the following problem arises. In the case of feeding sheet from the main body sheet feeding tray, the sheet feeding is not started when the main body sheet feeding tray is not attached to the proper position, so that a jam does not occur. That is, such a sensor is not necessarily required when the optional sheet feeding device is not added. The optional sheet feeding device is often retrofitted optionally, and in some cases only about 10% of users of the image forming apparatus main body buy the optional sheet feeding device.

Therefore, previously providing all the image forming apparatus main bodies with the sensor that is not necessarily required for the user who does not add the optional sheet feeding device leads to an increase in cost of the image forming apparatus for many users. Therefore, the present invention provides an image forming apparatus and an optional sheet feeding device in which whether or not a main body sheet feeding tray is attached to a proper position is detected in the case of expanding the optional sheet feeding device on the lower side of the main body sheet feeding tray without providing an image forming apparatus main body with an extra sensor.

According to one aspect of the present invention, there is provided an image forming apparatus including: an image forming apparatus main body including an image forming unit that forms an image on a sheet, a detachable main body sheet feeding tray that holds the sheet and a sheet feeding unit that feeds the sheet from the main body sheet feeding tray toward the image forming unit; an optional sheet feeding device that is capable of being added on a lower side of the main body sheet feeding tray and feeds the sheet toward the image forming unit, the optional sheet feeding device having a first detector that detects whether or not the main body sheet feeding tray is attached to a proper position; and a controller that controls operations of the image forming apparatus main body and the optional sheet feeding device based on a detection result of the first detector; wherein a portion of the main body sheet feeding tray constitutes a portion of a transport path of the sheet which extends from the optional sheet feeding device to the image forming unit when the main body sheet feeding tray is attached to the proper position.

In this configuration, the first detector for detecting whether or not the main body sheet feeding tray is attached to the proper position is disposed on the side of the optional sheet feeding device. Thus, the first detector, which becomes unnecessary when the optional sheet feeding device is not added, does not need to be disposed in the image forming apparatus main body. This leads to a reduction in cost of the image forming apparatus for a user who does not add the optional sheet feeding device.

Also, at the time of adding the optional sheet feeding device, it can be detected whether or not the main body sheet feeding tray is attached to the proper position by the first detector disposed on the optional sheet feeding device. Then, its detection result can be reflected on control of operations of the image forming apparatus main body and the optional sheet feeding device by the controller.

According to another aspect of the invention, there is provided an optional sheet feeding device that is capable of being added on a lower side of a main body sheet feeding tray of an image forming apparatus main body, which includes an image forming unit that forms an image on a sheet, a detachable main body sheet feeding tray that holds the sheet and a sheet feeding unit that feeds the sheet from the main body sheet feeding tray toward the image forming unit, and is capable of feeding the sheet toward the image forming unit when being added, including: a detector that detects whether or not the main body sheet feeding tray is attached to a proper position; wherein when the main body sheet feeding tray is attached to the proper position, a portion of the main body sheet feeding tray is used as a transport path and the sheet is transported to the image forming unit therethrough.

According to still another aspect of the invention, there is provided an image forming apparatus including: an image forming apparatus main body including an image forming unit that forms an image on a sheet, a detachable main body sheet feeding tray that holds the sheet, a sheet feeding unit that feeds the sheet from the main body sheet feeding tray toward the image forming unit, and a controller that controls at least the sheet feeding unit; wherein the image forming apparatus main body is capable of being added an optional sheet feeding device that feeds the sheet toward the image forming unit on a lower side of the main body sheet feeding tray; a portion of the main body sheet feeding tray constitutes a portion of a transport path of the sheet which extends from the optional sheet feeding device to the image forming unit when the main body sheet feeding tray is attached to a proper position; and when the optional sheet feeding device comprises a detector that detects whether or not the main body sheet feeding tray is attached to the proper position, the controller controls operations of the image forming apparatus main body and the optional sheet feeding device based on a detection result of the detector.

BRIEF DESCRIPTION OF THE DRAWINGS

The present invention may be more readily described with reference to the accompanying drawings.

DETAILED DESCRIPTION OF THE PREFERRED EMBODIMENTS

Figure 1:
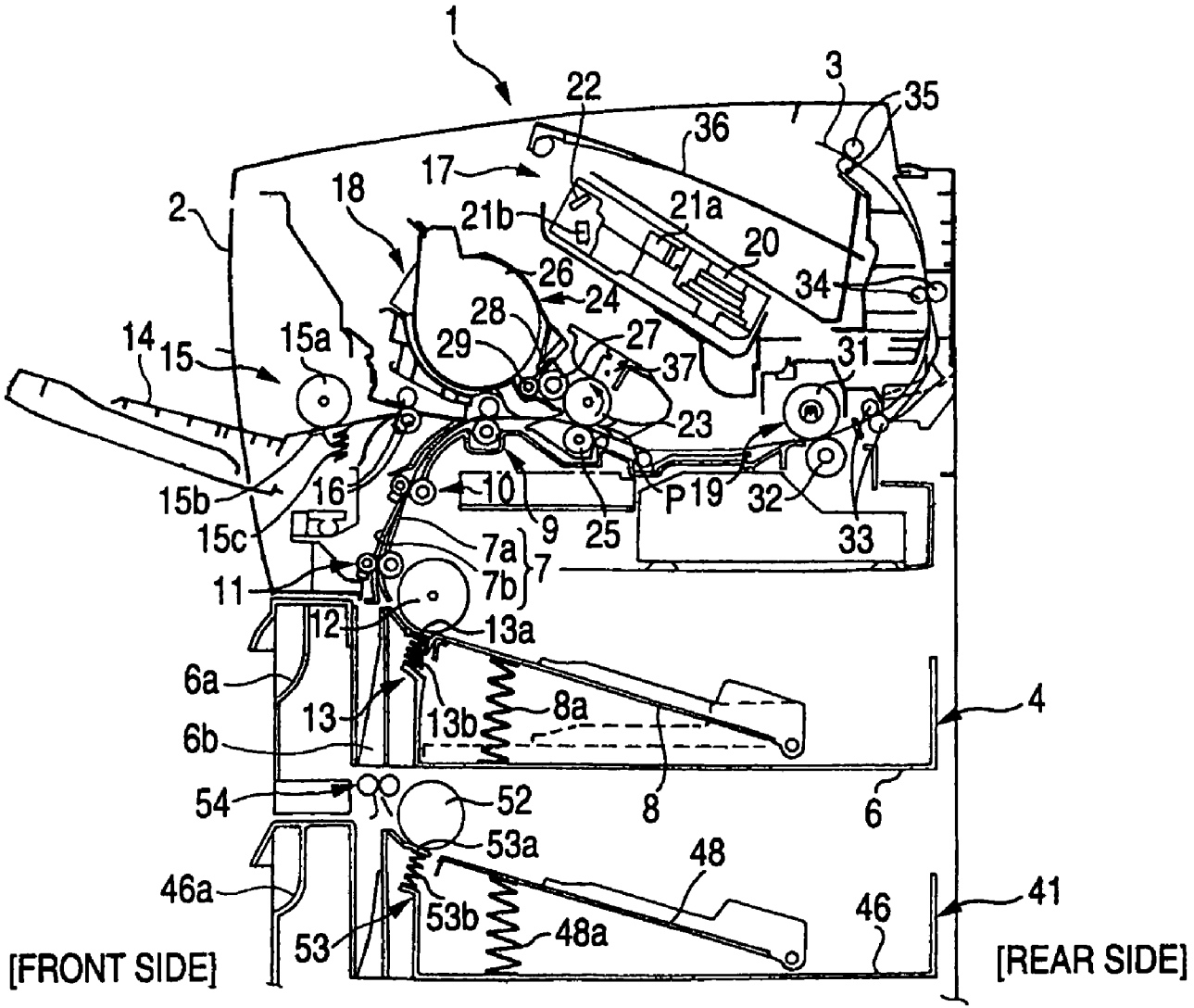
FIG. 1 is a schematic sectional view showing a configuration of a laser printer according to an embodiment of the invention.
Figure 2:
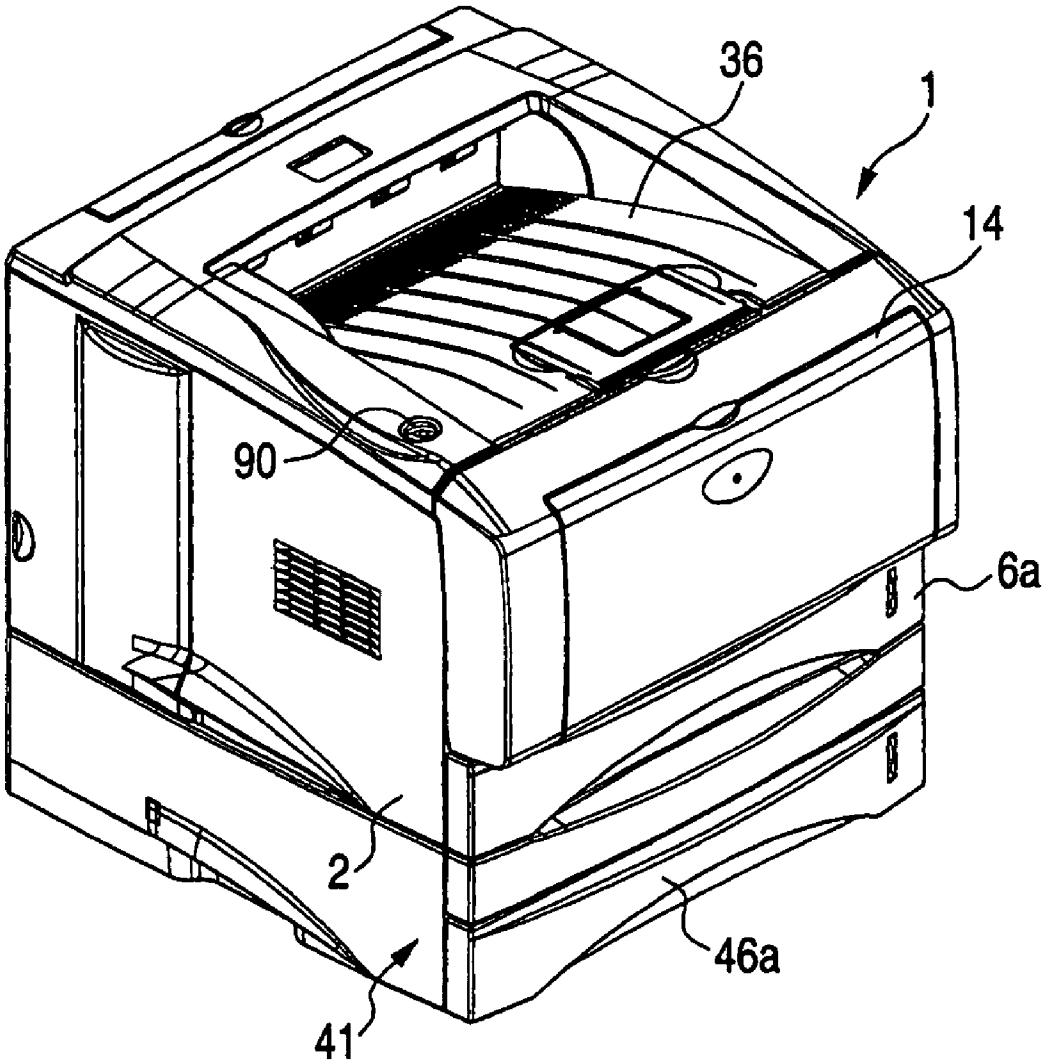
FIG. 2 is a perspective view showing an appearance of the laser printer.

An embodiment of the invention will be described below. Incidentally, the invention is not limited to the following embodiment and various other forms can be adopted as long as they belong to the technical scope of the invention. FIG. 1 is a schematic sectional view of a laser printer 1 as an image forming apparatus to which the invention is applied. FIG. 2 is a perspective view showing an appearance of the laser printer 1.

[Description of Configuration of Laser Printer 1]

As shown in FIG. 1, in the inside of a main body case 2, the laser printer 1 has a feeder part 4 for feeding a sheet 3 functioning as a recording medium, a multipurpose tray 14, a process unit 18 for forming an image on the sheet 3 thus fed, and a fixing device 19, etc. This laser printer 1 is configured so that an optional tray 41 functioning as an optional sheet feeding device can be added optionally on the lower portion of the feeder part 4. Incidentally, in this laser printer 1, the side (left side in FIG. 1) in which the multipurpose tray 14 is attached to the main body case 2 is set as "the front side" and the side opposite to the side in which the multipurpose tray 14 is attached to the main body case 2 is set as "the rear side".

[Description of Configuration of Feeder Part 4]

As shown in FIG. 1, in the bottom of the inside of the main body case 2, the feeder part 4 has a main body sheet feeding tray 6 detachably attached, a sheet press plate 8 disposed inside the main body sheet feeding tray 6, a sheet feeding roller (hereinafter called as "main body sheet feeding roller") 12 disposed in the upper portion of one end side of the main body sheet feeding tray 6, and a separation pad 13. Also, a transport path 7 formed in a curved shape is disposed in the range from the main body sheet feeding roller 12 to an image formation position P (a portion of contact between a photosensitive drum 23 and a transfer roller 25, that is, a transfer position in which a toner image on the photosensitive drum 23 is transferred to the sheet 3).

The sheet press plate 8 can hold the sheet 3 in a stack state and is configured so that the nearer end can move in a vertical direction by swingably supporting the sheet press plate 8 at the further end with respect to the main body sheet feeding roller 12 and also is urged upward from the back side by a spring 8*a*. The separation pad 13 is disposed in a state opposed to the main body sheet feeding roller 12 and a pad 13*a* made of a member with a high coefficient of friction is pressed against the main body sheet feeding roller 12 by a spring 13*b*.

Figure 4:
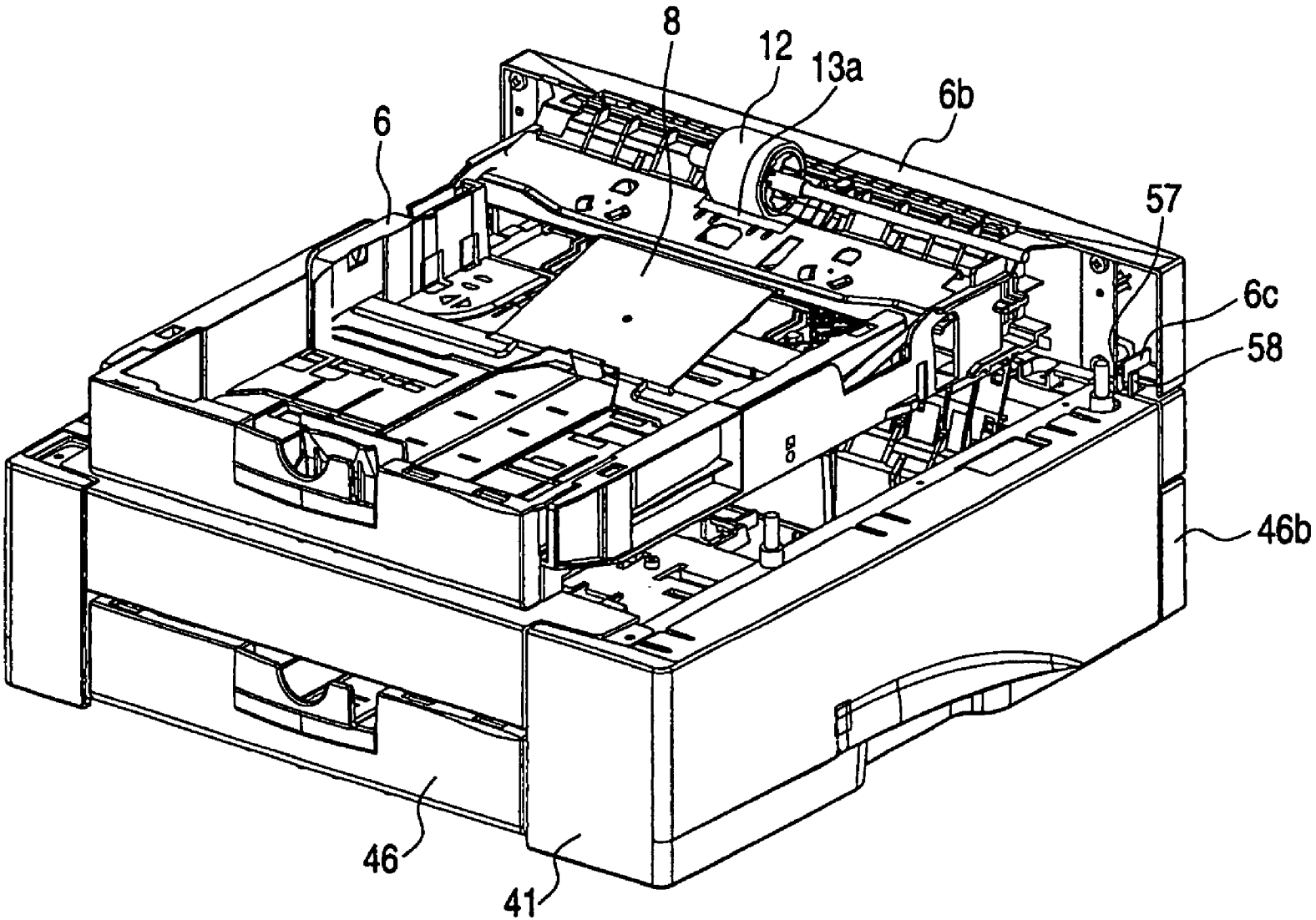
FIG. 4 is a perspective view showing a configuration of a main body tray draw sensor of the optional tray.

Incidentally, the pad 13*a* and the main body sheet feeding roller 12 are formed so that a width dimension of a direction perpendicular to a transport direction of the sheet 3 is shorter than a width dimension of the sheet 3 and the pad 13*a* and the roller 12 come into contact with the sheet 3 only at the approximately center of the width direction of the sheet 3 at the time of sheet feeding (see FIG. 4).

The transport path 7 is formed in the curved shape by arranging a pair of guide plates 7*a*, 7*b* for guiding a surface of the sheet 3. Also, in this transport path 7, the main body sheet feeding roller 12, a pair of transport rollers 11 composed of a driving roller and a driven roller, a pair of transport rollers 10 composed of a driving roller and a driven roller, and a pair of registration rollers 9 which are arranged immediately before the image formation position P and are composed of a driving roller and a driven roller are arranged at appropriate intervals sequentially from the upstream side of sheet transport. Also, immediately before the registration rollers 9, a well-known registration sensor 92 (see FIG. 5) for detecting whether or not the sheet 3 is transported to that position is disposed.

In the feeder part 4 configured as described above, after the uppermost sheet 3 of the sheets 3 stacked on the sheet press plate 8 is pressed against the main body sheet feeding roller 12 and is pinched between the main body sheet feeding roller 12 and the separation pad 13 by rotation of the main body sheet feeding roller 12, the sheet is fed one by one. It is constructed so that the thus fed sheet 3 is transported by the transport rollers 11 and then is sequentially fed to the transport rollers 10 and the registration rollers 9 and the sheet 3 is fed to the image formation position P after a predetermined registration.

[Description of Configuration of Multipurpose Tray 14]

The multipurpose tray 14 for feeding a sheet 3 manually and a multipurpose side sheet feeding mechanism 15 for feeding sheets 3 stacked on the multipurpose tray 14 are disposed in the front side of the main body case 2 of an upper position from the feeder part 4. The multipurpose side sheet feeding mechanism 15 has a multipurpose side sheet feeding roller 15*a* and a multipurpose side sheet feeding pad 15*b*, and the multipurpose side sheet feeding pad 15*b* is pressed against the multipurpose side sheet feeding roller 15*a* by a spring 15*c* disposed in the back side of the multipurpose side sheet feeding pad 15*b*. Also, the multipurpose tray 14 has a pair of transport rollers 16 composed of a driving roller and a driven roller.

In the multipurpose tray 14 configured as described above, the sheets 3 stacked on the multipurpose tray 14 are pinched by the multipurpose side sheet feeding roller 15*a* that rotates and the multipurpose side sheet feeding pad 15*b* and then are fed one by one and are fed to the registration rollers 9 through the pair of the transport rollers 16.

[Description of Configuration of Scanner Unit 17]

A scanner unit 17 is arranged in the lower side of a sheet discharge tray 36 of the upper portion of the main body case 2, and has a laser emitting part (not shown), a polygon mirror 20 rotated and driven, lenses 21*a* and 21*b*, a reflecting mirror 22, etc. A laser beam in accordance with image data emitted from the laser emitting part is passed or reflected in order of the polygon mirror 20, the lens 21*a*, the reflecting mirror 22 and the lens 21*b*, and is applied on a surface of the photosensitive drum 23 in the process unit 18 by fast scanning.

[Description of Configuration of Process Unit 18]

The process unit 18 has a drum cartridge having a transfer roller 25, a scorotron type charger 37, the photosensitive drum 23, and a developing cartridge 24 attachable to or detachable from the drum cartridge. The developing cartridge 24 has a toner receiving part 26, a developing roller 27, a layer thickness regulating blade 28, a toner supply roller 29, etc.

The toner receiving part 26 is filled with non-magnetic mono-component polymerization toner with positive charging properties as a developer and the toner is supplied to the developing roller 27 by the toner supply roller 29 and at this time, the toner is positively frictionally charged between the toner supply roller 29 and the developing roller 27. Further, the toner supplied on the developing roller 27 is carried on the developing roller 27 as a thin layer of a certain thickness by sliding friction of the layer thickness regulating blade 28 with rotation of the developing roller 27. On the other hand, the photosensitive drum 23 rotating is arranged as opposed to the developing roller 27. A drum body is grounded and also, its surface is formed by organic photoconductor material, for example, a photoconductive layer with positive charging properties made of polycarbonate, etc.

This laser printer 1 is constructed so that after a toner image is transferred to the sheet 3 by the transfer roller 25, the remaining toner remaining on a surface of the photosensitive drum 23 is recovered by the developing roller 27, that is, the remaining toner is recovered by the so-called method without a cleaner. When the remaining toner on the surface of the photosensitive drum 23 is recovered by such the method without the cleaner, there is no need to dispose preservation means of waste toner or a cleaner device such as a blade, so that cost reduction, miniaturization and simplification of a configuration of the apparatus can be achieved.

The scorotron type charger 37 is disposed at a predetermined spacing from the photosensitive drum 23 so as not to be in contact with the photosensitive drum 23. The scorotron type charger 37 is a scorotron type charger for positive charging for generating a corona discharge from a wire for charging of tungsten, etc., and is constructed so that a surface of the photosensitive drum 23 is uniformly charged in positive polarity.

The surface of the photosensitive drum 23 is first uniformly positively charged with rotation of the photosensitive drum 23 by the scorotron type charger 37 and thereafter is exposed by fast scanning of a laser beam from the scanner unit 17 and an electrostatic latent image based on image data is formed.

Subsequently, at the time of making opposite contact with the photosensitive drum 23, toner positively charged and carried on the developing roller 27 by rotation of the developing roller 27 is supplied to an electrostatic latent image formed on the surface of the photosensitive drum 23, that is, an exposure portion with a decreased potential exposed by a laser beam among the surface of the photosensitive drum 23 uniformly positively charged and is selectively carried and thereby the toner is visualized and thus a toner image is achieved.

The transfer roller 25 is arranged under the photosensitive drum 23 as opposed to this photosensitive drum 23 and is rotatably supported in the drum cartridge clockwise in FIG. 1. A metallic roller shaft of this transfer roller 25 is coated with a roller made of ionic conductive rubber material and it is constructed so that a transfer bias (transfer forward bias) is applied from a transfer bias applied power source at the time of transfer. As a result, a toner image carried on the surface of the photosensitive drum 23 is transferred to the sheet 3 in the image formation position P described above while the sheet 3 passes through a gap between the photosensitive drum 23 and the transfer roller 25.

[Description of Configuration of Fixing Device 19]

As shown in FIG. 1, the fixing device 19 is disposed in the transport direction downstream side from the process unit 18, and has a heating roller 31, a pressurizing roller 32 arranged so as to press this heating roller 31, and a pair of transport rollers 33 disposed in the downstream side of these rollers. The heating roller 31 has a heater such as a halogen lamp made of metal such as aluminum for heating, and toner transferred on the sheet 3 in the process unit 18 is thermally fixed while the sheet 3 passes through a gap between the heating roller 31 and the pressurizing roller 32. Thereafter, by the transport rollers 33, the sheet 3 is transported by transport rollers 34 and sheet discharge rollers 35 in a sheet delivery path of the back side inside the main body case 2 and then is discharged on the sheet discharge tray 36. Incidentally, together with the scanner unit 17 and the process unit 18, the fixing device 19 functions as an image forming unit.

[Description of Configuration of Optional Tray 41]

The inner structure of the optional tray 41 capable of being added to the lower portion of the feeder part 4 is similar to that of the feeder part 4. That is, the optional tray 41 has an optional sheet feeding tray 46 detachably attached to the bottom, a sheet press plate 48 urged by a spring 48*a*, one of the sheet press plate being swingably supported in the bottom of the optional sheet feeding tray 46, a sheet feeding roller (hereinafter called as "optional sheet feeding roller") 52 disposed in the upper portion of the other end of the sheet press plate 48, and a separation pad 53. The separation pad 53 is disposed in a state opposed to the optional sheet feeding roller 52 and a pad 53*a* made of a member with a high coefficient of friction is pressed against the optional sheet feeding roller 52 by a spring 53*b*.

Also, in the main body sheet feeding tray 6 attached to the feeder part 4, a passage 6*b* capable of passing sheet 3 in a vertical direction is formed between a knob part 6*a* of the front side and a swing range of the sheet press plate 8. Further, a pair of transport rollers 54 composed of a driving roller and a driven roller are disposed in the lower portion of the passage 6*b*. When the main body sheet feeding tray 6 of the feeder part 4 is attached to a proper position (a position in which the sheet 3 can be fed to the transport path 7 by the main body sheet feeding roller 12), the sheet 3 fed by the optional sheet feeding roller 52 of the optional tray 41 one by one is transported by a pair of the transport rollers 54 and then passes through the passage 6*b* and is fed to the transport path 7 by the transport rollers 11.

Figure 3:
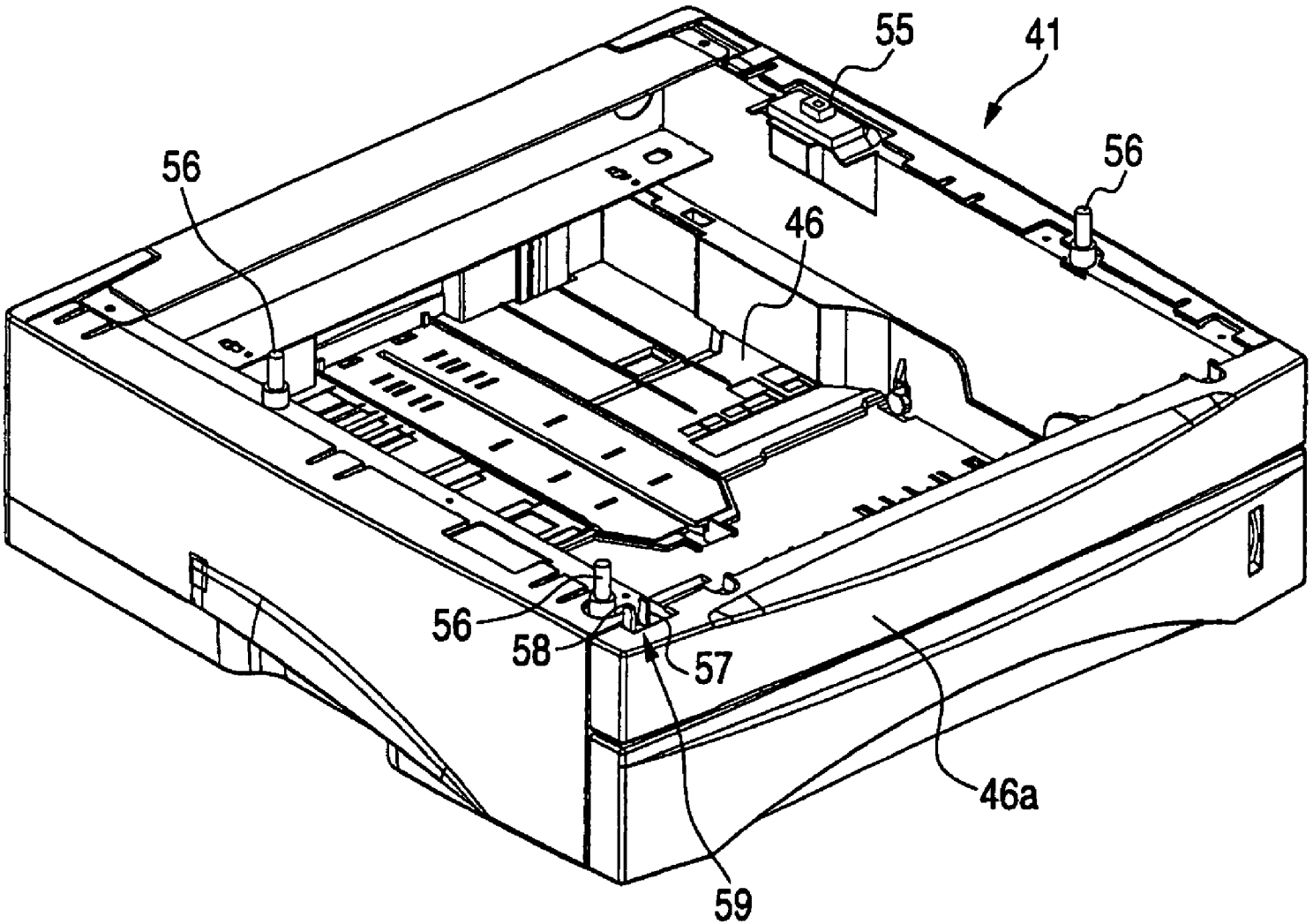
FIG. 3 is a perspective view showing a configuration of an optional tray of the laser printer.

Also, as shown in FIG. 3, a connector 55 and pins 56 are disposed on an upper surface of the optional tray 41. When the optional tray 41 is attached to the lower portion of the feeder part 4, the connector 55 is electrically connected to a CPU 61 (see FIG. 5) of the laser printer 1 disposed inside the main body case 2. The pins 56 are protrusively disposed at appropriate intervals in order to position the optional tray 41 with respect to the main body case 2. Incidentally, FIG. 3 is a perspective view showing a configuration of the optional tray 41 with a configuration of the sheet press plate 48, the optional sheet feeding roller 52, the separation pad 53, etc., omitted.

Further, as shown in FIGS. 3 and 4, a light emitting element 57 and a light receiving element 58 are disposed on a frame upper surface of the optional tray 41 disposed in the upper portion of a knob part 46*a* of the optional sheet feeding tray 46. A shutter 6*c* for shutting an optical path extending from the light emitting element 57 to the light receiving element 58 when the main body sheet feeding tray 6 is attached to the proper position as shown in FIG. 4 is protrusively disposed on the back surface (rear side) of the knob part 6*a* of the main body sheet feeding tray 6. As a result, it can be detected whether or not the main body sheet feeding tray 6 of the main body side is attached to the proper position by detecting whether or not light emitted from the light emitting element 57 can be received by the light receiving element 58 when the optional tray 41 is added.

Control of this light emitting element 57 and detection of a light receiving state of the light receiving element 58 are performed by the CPU 61 through the connector 55 described above. Hereinafter, the light emitting element 57 and the light receiving element 58 are also called a main body tray draw sensor 59 collectively (see FIG. 5).

[Description of Control System of Laser Printer 1]

Figure 5:
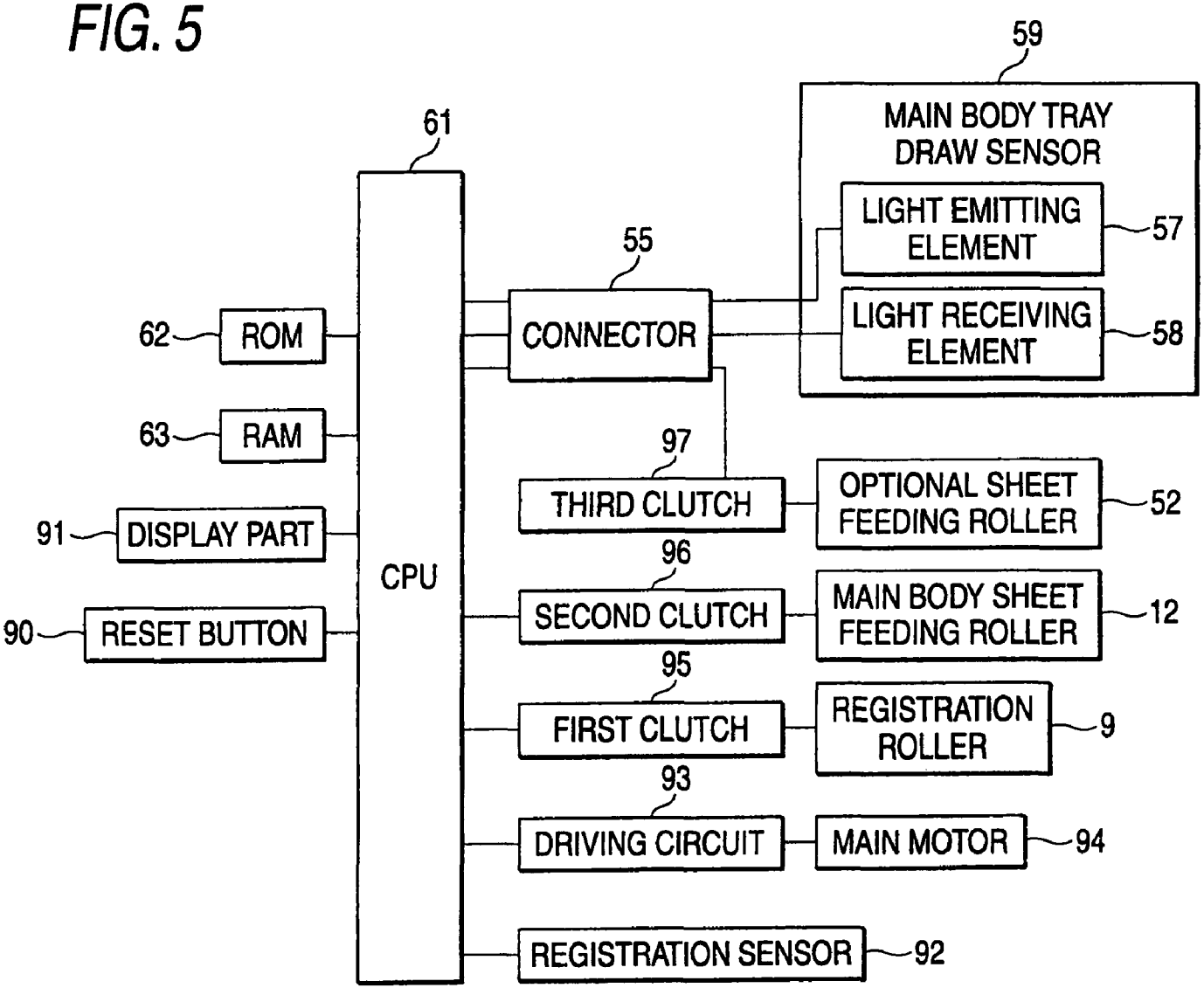
FIG. 5 is a block diagram showing a configuration of a control system of the laser printer.

Next, a control system of the laser printer 1 will be described with reference to a block diagram of FIG. 5. As shown in FIG. 5, this control system has a CPU (central processing unit) 61 for doing various calculations for control of transport operation, etc., ROM (read-only memory) 62 in which control programs, etc., are stored, and RAM (random-access memory) 63 in which various data is temporarily stored. Also, the CPU 61 can receive commands of image formation or a print job through an input/output interface (not shown) from a computer, etc., (not shown).

In addition, a reset button 90 (see FIG. 2) disposed on a surface of the main body case 2, a display part 91, the light emitting element 57 and the light receiving element 58 functioning as the main body tray draw sensor 59, and a registration sensor 92 are connected to the CPU 61. Also, a main motor 94 for driving the photosensitive drum 23 and various rollers described above is connected to the CPU 61 through a driving circuit 93 and further a first clutch 95, a second clutch 96 and a third clutch 97 for switching whether or not driving force of the main motor 94 is transmitted to the registration roller 9, the main body sheet feeding roller 12 and the optional sheet feeding roller 52 are connected to the CPU 61. Incidentally, the main body tray draw sensor 59 and the third clutch 97 among these are connected to the CPU 61 when the connector 55 is connected as described above.

[Description of Print Processing]

Subsequently, print processing performed in the control system of the laser printer 1 will be described with reference to FIG. 6. First, the control system of the laser printer 1 generally performs the following image data generation processing in the case of receiving a print job from a personal computer, etc., (not shown) in a state of turning on a power source of the laser printer 1. That is, after the received print job is once stored in the RAM 63, its print job is analyzed and also the contents of setting of its print condition information are checked and data included in the print job is converted into image data. Incidentally, the print condition information includes information as to whether to feed sheet from the main body sheet feeding tray 6 or from the optional sheet feeding tray 46.

Figure 6:
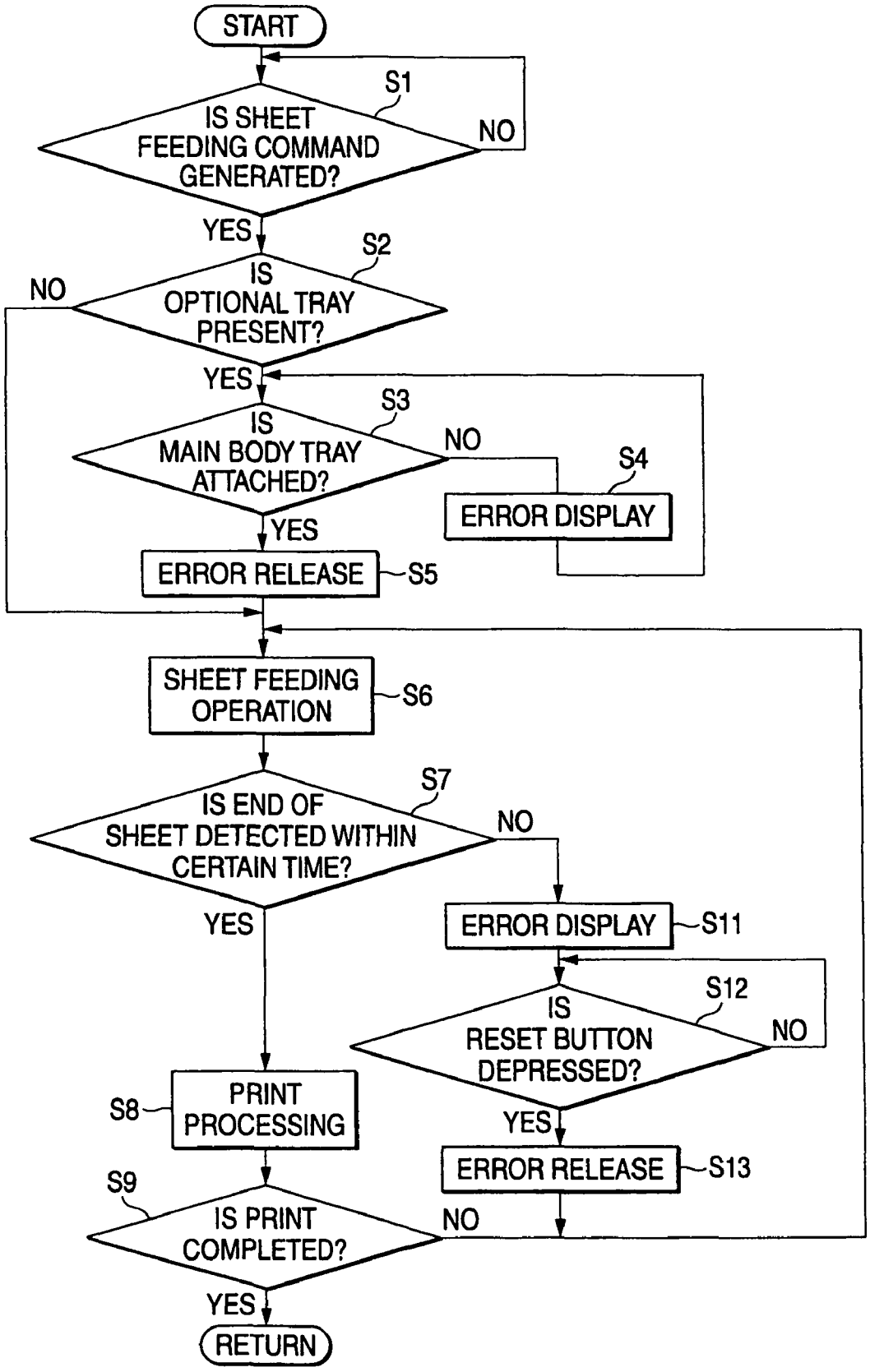
FIG. 6 is a flowchart showing print processing performed by the control system.

The print processing shown in FIG. 6 is performed after the image data generation processing is performed at the time when a power source of the laser printer 1 is turned on and an initial operation is performed and it is in a wait state. Incidentally, in the initial operation, the following action is performed. That is, the initial operation in which the developing roller 27, the transfer roller 25 and the photosensitive drum 23 in the process unit 18 and the heating roller 31 of the fixing device 19 are rotated and also a power source of the heater of the heating roller 31 is turned on is performed by actuating a main motor, etc.

When the print processing is started, it waits in S1 (S indicates a step: the same applies to the following) until a sheet feeding command is generated after receiving the completion of the image data generation processing described above. When the sheet feeding command is generated (S1: YES), the print processing proceeds to S2 and it is detected whether or not the optional tray 41 is added. This detection is made by detecting whether or not the connector 55 of the optional tray 41 is connected by inputting and outputting a signal to a connector (not shown) of the side of the laser printer 1 connected to the connector 55.

Then, when the optional tray 41 is added (S2: YES), in S3, a detection result of the main body tray draw sensor 59 is read out and it is detected whether or not the main body sheet feeding tray 6 is attached to the proper position. When it is not attached to the proper position (S3: NO), after error display is performed on the display part 91 in S4, the print processing again proceeds to S3.

When the main body sheet feeding tray 6 is not attached to the proper position, the main body sheet feeding roller 12 does not abut on the sheet 3 held on the sheet press plate 8, so that sheet feeding from the main body sheet feeding tray 6 cannot be performed. Also, the passage 6*b* is not disposed in a proper position, so that sheet feeding from the optional sheet feeding tray 46 cannot be performed. That is, it is impossible to do printing even in the case that the print job is to feed sheet from any of the main body sheet feeding tray 6 or the optional sheet feeding tray 46 when the main body sheet feeding tray 6 is not attached to the proper position. Therefore, in this case (S3: NO), error display is performed on the display part 91 (S4) and it waits until the main body sheet feeding tray 6 is attached to the proper position.

On the other hand, when the main body sheet feeding tray 6 is attached to the proper position (S3: YES), after the error display is released in S5, the print processing proceeds to S6 and a sheet feeding operation is executed. Also, when the main body sheet feeding tray 6 is attached to the proper position from the beginning (S3: YES), error display is not performed from the beginning, so that the print processing proceeds to S6 as it is and when the optional tray 41 is not added (S2: NO), a sheet feeding operation is similarly executed by directly proceeding from S2 to S6.

This sheet feeding operation is executed by driving the sheet feeding roller (12 or 52) corresponding to the sheet feeding tray (6 or 46) instructed by the print condition information when the optional tray 41 is added, and is executed by driving the main body sheet feeding roller 12 when the optional tray 41 is not added.

In S7, it is determined whether or not the end of sheet 3 is detected within a certain period of time based on a detection signal from the registration sensor 92. Incidentally, this certain time is set at the time enough for the sheet 3 to be transported to the image formation position P since the sheet feeding operation was started. Then, when the end of the sheet 3 is detected within its certain time (S7: YES), the process unit 18 and the image forming unit described above are driven and print processing to the sheet 3 is performed (S8).

In S9 next to S8, it is determined whether or not print corresponding to the print job is completed, and when it is not completed (S9: NO), the print processing proceeds to S6. Then, by repeatedly performing the processing of S6 to S9, the sheet feeding operation (S6) and the print processing (S8) are repeated and when the print corresponding to the print job is completed (S9: YES), the processing is once ended.

On the other hand, when a jam, etc., occurs in the range from the sheet feeding tray (6 or 46) to the registration roller 9, the end of the sheet 3 is not detected within the certain time from the start of the sheet feeding operation (S7: NO). Also, when the optional tray 41 is not added (S2: NO), it cannot be detected whether or not the main body sheet feeding tray 6 is attached to the proper position, but when it is not attached to the proper position, the sheet feeding operation by the main body sheet feeding roller 12 cannot be executed, so that the end of the sheet 3 is not detected within the certain time similarly (S7: NO).

Therefore, in such a case, after error display is performed on the display part 91 in S11, it waits until the reset button 90 is depressed in S12. When a user completes jam handling, etc., and depresses the reset button 90 (S12: YES), after the error display is released in S13, the processing proceeds to S6 and the sheet feeding operation is resumed.

In this embodiment, the optional tray 41 is provided with the main body tray draw sensor 59 for detecting whether or not the main body sheet feeding tray 6 is attached to the proper position, so that cost reduction of the main body of the laser printer 1 can be achieved. Also, when the optional tray 41 is added, it can be decided whether or not the main body sheet feeding tray 6 is attached to the proper position by the main body tray draw sensor 59, so that the following effects are obtained by reflecting that decision on control as described above.

That is, when the main body sheet feeding tray 6 is not attached to the proper position (S3: NO), sheet feeding cannot be performed from any of the main body sheet feeding tray 6 or the optional sheet feeding tray 46. Therefore, in this case, sheet feeding from any of the main body sheet feeding tray 6 and the optional sheet feeding tray 46 can be inhibited to well prevent the occurrence of a jam, etc. Also, when the optional tray 41 is not added (S2: NO), it cannot refer to a detection result of the main body tray draw sensor 59. Therefore, in this case, useless decision processing can be eliminated by omitting the processing (S3) for referring to the detection result of the main body tray draw sensor 59 and can start the sheet feeding operation (S6).

Incidentally, when the main body sheet feeding tray 6 is not attached to the proper position (S3: NO), sheet feeding from any of the main body sheet feeding tray 6 and the optional sheet feeding tray 46 is inhibited in the processing, but even when the main body sheet feeding roller 12 is driven at this time, the sheet 3 is not transported at all and it does not become a cause of a jam, etc. Therefore, when the main body sheet feeding tray 6 is not attached to the proper position (S3: NO), only sheet feeding from the optional sheet feeding tray 46 may be inhibited. In this case, even when the sheet feeding operation from the main body sheet feeding tray 6 is executed (S6), the end of the sheet 3 is not detected within a certain time (S7), so that error display is performed at this point in time (S11)

In this case, the normal sheet feeding operation (S6) is executed by attaching the main body sheet feeding tray 6 to the proper position and depressing the reset button 90 (S12). On the other hand, in the present embodiment, when the main body sheet feeding tray 6 is not attached to the proper position (S3: NO), the normal sheet feeding operation (S6) is executed by only attaching the main body sheet feeding tray 6 to the proper position (S3: YES). Accordingly, operability improves more. Also, a useless sheet feeding operation is not executed, so that a print speed as a whole can be improved.

In the present embodiment described above, the main body sheet feeding roller 12 functions as a sheet feeding unit, the optional tray 41 functions as an optional sheet feeding device, the main body tray draw sensor 59 functions as a first detector, the CPU 61 functions as a controller, the connector 55 functions as a second detector, and the processing of S2 functions as a determining unit, respectively.

Also, in the embodiment, the first detector is constructed by the optical main body tray draw sensor 59, but the first detector can also be constructed by a contact type sensor such as a limit switch or a magnetic sensor. Further, the laser printer 1 may be sold separately from the optional tray 41, and the optional tray 41 may be sold singly. Furthermore, the invention is not limited to the electrophotographic type image forming apparatus as described above, and can be applied to various image forming apparatus such as an ink-jet printer.

What is claimed is:

1. An image forming apparatus comprising:

an image forming apparatus main body including an image forming unit that forms an image on a sheet, a detachable main body sheet feeding tray that holds the sheet and a sheet feeding unit that feeds the sheet from the main body sheet feeding tray toward the image forming unit;

an optional sheet feeding device that is capable of being added on a lower side of the main body and feeds the sheet toward the image forming unit, the optional sheet feeding device having a first detector capable of detecting whether or not the main body sheet feeding tray is attached to a proper position; and a controller that controls operations of the image forming apparatus main body and the optional sheet feeding device based on a detection result of the first detector;

wherein a portion of the main body sheet feeding tray constitutes a portion of a transport path of the sheet which extends from the optional sheet feeding device to the image forming unit when the main body sheet feeding tray is attached to the proper position, and wherein the first detector comprises a light emitting element and a light receiving element; and a shutter that is protrusively disposed on the main body sheet feeding tray and shuts an optical path extending from the light emitting element to the light receiving element when the main body sheet feeding tray is attached to the proper position; and further comprising a second detector capable of detecting that the optional sheet feeding device is added and capable of detecting that the optional sheet feeding device is not added.

2. The image forming apparatus according to claim 1, wherein the controller comprises a determining unit that determines whether or not the optional sheet feeding device is added based on a detection result of the second detector, and a control method is changed based on a determination of the determining unit.

3. The image forming apparatus according to claim 2, wherein when the controller determines that the optional sheet feeding device is added through the determination unit, the first detector detects whether or not the main body sheet feeding tray is attached to the proper position, and when it is detected that the main body sheet feeding tray is not attached to the proper position, a sheet feeding operation by any of the sheet feeding unit and the optional sheet feeding device is inhibited; and when it is detected that the optional sheet feeding device is not added, a sheet feeding operation by the sheet feeding unit is executed regardless of a detection result of the first detector.

4. The image forming apparatus according to claim 1, wherein the main body sheet feeding tray comprises a front cover that faces to a direction toward which the main body sheet feeding tray is detached from the image forming apparatus main body, and the shutter is disposed on a rear side of the front cover.

5. The image forming apparatus according to claim 2, wherein the second detector comprises a connector disposed on the optional sheet feeding device.

6. An image forming apparatus comprising:

an image forming apparatus main body including an image forming unit that forms an image on a sheet, a detachable main body sheet feeding tray that holds the sheet and a sheet feeding unit that feeds the sheet from the main body sheet feeding tray toward the image forming unit;

an optional sheet feeding device that is capable of being added on a lower side of the main body and feeds the sheet toward the image forming unit, the optional sheet feeding device having a first detector capable of detecting whether or not the main body sheet feeding tray is attached to a proper position; and a controller that controls operations of the image forming apparatus main body and the optional sheet feeding device based on a detection result of the first detector;

wherein a portion of the main body sheet feeding tray constitutes a portion of a transport path of the sheet which extends from the optional sheet feeding device to the image forming unit when the main body sheet feeding tray is attached to the proper position, and wherein the controller determines that an error has occurred or the main body sheet feeding tray is not attached to the proper position when the sheet is not transported to the image forming unit even after a certain period of time has elapsed since the sheet feeding unit executed a sheet feeding operation.

7. An optional sheet feeding device that is capable of being added on a lower side of a main body of an image forming apparatus main body, which includes an image forming unit that forms an image on a sheet, a detachable main body sheet feeding tray that holds the sheet and a sheet feeding unit that feeds the sheet from the main body sheet feeding tray toward the image forming unit, and is capable of feeding the sheet toward the image forming unit when being added, comprising:

a detector capable of detecting whether or not the main body sheet feeding tray is attached to a proper position;

wherein when the main body sheet feeding tray is attached to the proper position, a portion of the main body sheet feeding tray is used as a transport path and the sheet is transported to the image forming unit therethrough, and wherein the detector comprises a light emitting element and a light receiving element; and a shutter that is protrusively disposed on the main body sheet feeding tray and shuts an optical path extending from the light emitting element to the light receiving element when the main body sheet feeding tray is attached to the proper position.

8. An image forming apparatus comprising:

an image forming apparatus main body including an image forming unit that forms an image on a sheet, a detachable main body sheet feeding tray that holds the sheet, a sheet feeding unit that feeds the sheet from the main body sheet feeding tray toward the image forming unit, and a controller that controls at least the sheet feeding unit;

wherein the image forming apparatus main body is capable of having an optional sheet feeding device that feeds the sheet toward the image forming unit added on a lower side of the main body;

a portion of the main body sheet feeding tray constitutes a portion of a transport path of the sheet which extends from the optional sheet feeding device to the image forming unit when the main body sheet feeding tray is attached to a proper position; and wherein, when the optional sheet feeding device comprises a detector capable of detecting whether or not the main body sheet feeding tray is attached to the proper position, the controller controls operations of the image forming apparatus main body and the optional sheet feeding device based on a detection result of the detector, and wherein the detector comprises a light emitting element and a light receiving element; and a shutter that is protrusively disposed on the main body sheet feeding tray and shuts an optical path extending from the light emitting element to the light receiving element when the main body sheet feeding tray is attached to the proper position.

* * * * *